US009980025B2

(12) United States Patent
Klose

(10) Patent No.: US 9,980,025 B2
(45) Date of Patent: May 22, 2018

(54) METHOD FOR PRODUCING A MICROPHONE UNIT AND A MICROPHONE UNIT

(71) Applicant: Peiker Acustic GmbH & Co. KG, Friedrichsdorf (DE)

(72) Inventor: Michael Klose, Friedrichsdorf (DE)

(73) Assignee: Peiker Acustic GmbH & Co. KG, Friedrichsdorf (DE)

( * ) Notice: Subject to any disclaimer, the term of this patent is extended or adjusted under 35 U.S.C. 154(b) by 0 days. days.

(21) Appl. No.: 15/176,363

(22) Filed: Jun. 8, 2016

(65) Prior Publication Data

US 2016/0359248 A1 Dec. 8, 2016

(30) Foreign Application Priority Data

Jun. 8, 2015 (DE) ..... 10 2015 108 945

(51) Int. Cl.

| | |
|---|---|
| ***H04R 1/04*** | (2006.01) |
| ***H01R 43/24*** | (2006.01) |
| ***H04R 31/00*** | (2006.01) |
| ***H01R 12/58*** | (2011.01) |
| ***H01R 13/66*** | (2006.01) |
| *H01R 13/405* | (2006.01) |

(52) U.S. Cl.

CPC ..... *H04R 1/04* (2013.01); *H01R 12/585* (2013.01); *H01R 13/6658* (2013.01); *H01R 43/24* (2013.01); *H04R 31/006* (2013.01); *H01R 13/405* (2013.01); *Y10T 29/49128* (2015.01); *Y10T 29/49135* (2015.01); *Y10T 29/49139* (2015.01); *Y10T 29/49147* (2015.01)

(58) Field of Classification Search

CPC ... H04R 1/02; H04R 1/04; H04R 1/06; H04R 31/006; H01R 13/405; H01R 13/6658; H01R 43/24; H01R 12/585; Y10T 29/49005; Y10T 29/49128; Y10T 29/49139; Y10T 29/49135; Y10T 29/49147

See application file for complete search history.

(56) References Cited

U.S. PATENT DOCUMENTS 5,448,646 A * 9/1995 Lucey ..... H04M 1/60 381/309
6,162,093 A * 12/2000 Sudol ..... H01R 13/112 439/606

(Continued)

FOREIGN PATENT DOCUMENTS

DE 10 2013 014 526 A1 3/2015
EP 2239821 A2 * 10/2010 ..... H01R 31/06

*Primary Examiner* — Peter DungBa Vo
*Assistant Examiner* — Jeffrey T Carley
(74) *Attorney, Agent, or Firm* — Burr & Brown, PLLC

(57) ABSTRACT

The present invention relates to a method for producing a microphone unit, which can be contacted by a plug connector, and a microphone unit, wherein this comprises a housing, a circuit board having a microphone component and contacts, wherein the contacts are embodied on second contact ends as contact pins and wherein the contacts are connected at the first contact ends to the circuit board, wherein a multi-pole plug connector can be connected to the contact pins. The housing is embodied as a one-part injection molded part and the first contact ends are embodied as pressfit contacts.

8 Claims, 6 Drawing Sheets

(56) References Cited

U.S. PATENT DOCUMENTS

| | | | | |
|---|---|---|---|---|
| 7,798,831 | B2 * | 9/2010 | Sanford | H01R 43/24 439/180 |
| 7,971,337 | B2 * | 7/2011 | Kral | H04R 25/604 156/250 |
| 2003/0039374 | A1 * | 2/2003 | Sudo | H04R 1/04 381/355 |
| 2003/0202672 | A1 * | 10/2003 | Yamauchi | H04R 1/06 381/190 |
| 2008/0198559 | A1 * | 8/2008 | Mueller | G01D 11/245 361/728 |
| 2010/0261366 | A1 * | 10/2010 | Peiker | H01R 31/06 439/271 |
| 2012/0008805 | A1 * | 1/2012 | Hachinohe | B81B 7/0064 381/163 |
| 2013/0095701 | A1 * | 4/2013 | Golko | H01R 13/6581 439/660 |

* cited by examiner

METHOD FOR PRODUCING A MICROPHONE UNIT AND A MICROPHONE UNIT

This application claims the benefit under 35 USC § 119(a)-(d) of German Application No. 10 2015 108 945.9 filed Jun. 8, 2015, the entirety of which is incorporated herein by reference.

FIELD OF THE INVENTION

The present invention relates to a method for producing a microphone unit which can be contacted by a plug connector and a microphone unit comprising a housing, a circuit board having a microphone component and contacts.

BACKGROUND OF THE INVENTION

DE 10 2013 014 526 A1 discloses a microphone unit that can be contacted by a plug connector.

SUMMARY OF THE INVENTION

It is the object of the present invention to propose a method for producing a microphone unit and also a microphone unit of this type by means of which it is rendered possible to produce a microphone unit in an effective manner.

The method in accordance with the present invention for producing a microphone unit that can be contacted by means of a plug connector proposes the following mentioned steps:

- bending contacts, which are held in a non-displaceable manner with respect to one another by means of a bridge, in such a manner that contact ends that are part of the contacts and are embodied as pressfit ends include an angle of at least 90° in pairs with respect to contact ends that are part of the contacts and are adjacent to one another and embodied as contact pins,
- insert injection molding a first assembly, which comprises the contacts, with a housing in such a manner that the pressfit ends of the contacts protrude into a first hollow chamber of the housing and that the contact pins of the contacts protrude into a second hollow chamber of the housing,
- providing a second assembly, wherein the assembly is formed by virtue of mounting a microphone unit on a circuit board as a surface-mounted device,
- producing a pressfit connection between the pressfit ends of the contacts and the circuit board that is populated with the microphone unit as the circuit board is inserted into the first hollow chamber in such a manner that in so doing the pressfit ends of the contact pins are pressed into metal-lined through-going bores of the circuit board.

When using a method of this type during the production of the microphone unit, it is not necessary to mount devices in a multi-part housing but rather the complete microphone unit is assembled in steps quasi from inside outwards and completed by means of the prepared circuit board. As a consequence, it is possible to reduce the costs and improve the quality.

By virtue of insert injection molding the contacts so as to form the first assembly and by virtue of the associated production of a retaining plate that fixes the contacts, it is possible in a particularly easy manner to handle the first construction unit so as to prepare the insert injection molding process for forming the housing since the rigid retaining plate renders it possible to handle and orient the first construction unit without creating the risk that in so doing the contact pins become bent out of shape.

It is provided to insert injection mold the contacts in such a manner that the retaining plate is positioned on the contacts in such a manner that the retaining plate encases the contacts between bends, at which the contacts are bent, and the contact ends of the contacts, the contact ends being embodied as contact pins. As a consequence, the retaining plate is oriented with respect to the contact ends of the contact, the contact ends being formed as contact pins, in such a manner that these contact ends pass through the retaining plate without bending. Consequently, the contact ends of the contact that are embodied as contact pins are supported by means of the retaining plate in an optimal manner for plugging on and removing a plug connector.

It is also provided that the bridge is removed after the retaining plate has been formed and prior to the housing being produced. At this point in time, the first assembly is not yet constructed and can still be handled easily for the removal operation.

Insofar as the contacts are insert injection molded without first having to insert injection mold a retaining plate with the housing, it is provided to remove the bridge only after the housing has been produced. As a consequence, the contacts can still be handled as one prior to the insert injection molding process with the housing.

It is also provided to provide the circuit board with a dust protector after the circuit board is assembled in the first hollow chamber of the housing. As a consequence, the microphone component is particularly well protected in the housing.

Furthermore, it is provided during the production of the housing to embed at least one fastening pin, which is embodied according to a type of a pressfit end, in the housing, in such a manner that the fastening pin protrudes in a parallel manner with respect to the pressfit ends of the contacts in the first hollow chamber. As a consequence, it is possible to connect the fastening pins to the housing during the step in which the contacts or the first construction unit is also connected.

Finally, the method provides that, as the pressfit connection is produced between the pressfit ends of the contact pins and the circuit board, a pressfit connection is also produced between the pressfit end of the connecting pin or the pressfit ends of the connecting pins. As a consequence, it is possible to fix the circuit board to the housing at other sites during the process of producing the contacts and consequently to retain the circuit board permanently in a reliable manner in the second hollow chamber of the housing.

In the case of the microphone unit in accordance with the invention, the housing is embodied as a one-part injection molded part and the first contact ends of the contacts are embodied as pressfit contacts. In the case of a microphone unit of this type, it is neither necessary to seal a multi-part housing after the components are assembled nor is it necessary to perform a soldering process so as to connect the contacts to the circuit board. As a consequence, the costs are reduced and the quality improved.

In the sense of the invention, the term "process of insert injection molding" is understood to mean an injection molding operation according to the so-called "insert molding" method, in which an insert part or insert component or insert parts or insert components are arranged in a hollow chamber of an injection molding mold and then cast with a synthetic material, wherein a one-part component is produced whose individual components are fixedly connected to one another.

In the sense of the invention, the term "a surface-mounted device" is understood to mean a device such as for example a microphone component that is soldered directly to connection surfaces of a circuit board that are able to receive a soldering mass. In English, such a component is described as a so-called "surface-mount device", wherein the abbreviation "SMD" is used for this term.

In the sense of the present invention, the term "a pressfit connection" is understood to mean a connection where pressfit ends that are arranged on components are inserted into metal-lined bore holes of a circuit board in such a manner that the pressfit ends are deformed during the insertion process and thus a permanent and reliable electrical connection is produced between the pressfit ends and the metal-lined bore holes.

In the sense of the present invention, the term "a pressfit end of a contact" is understood to mean a contact end that is suitable as a result of its shape and its material characteristics to be pressed into a matching metal-lined through-going bore hole of a circuit board so as to form an electrical contact.

BRIEF DESCRIPTION OF THE DRAWINGS

Further details of the invention are described in the drawing with reference to schematically illustrated exemplary embodiments.

DETAILED DESCRIPTION OF THE INVENTION

Figure 1:
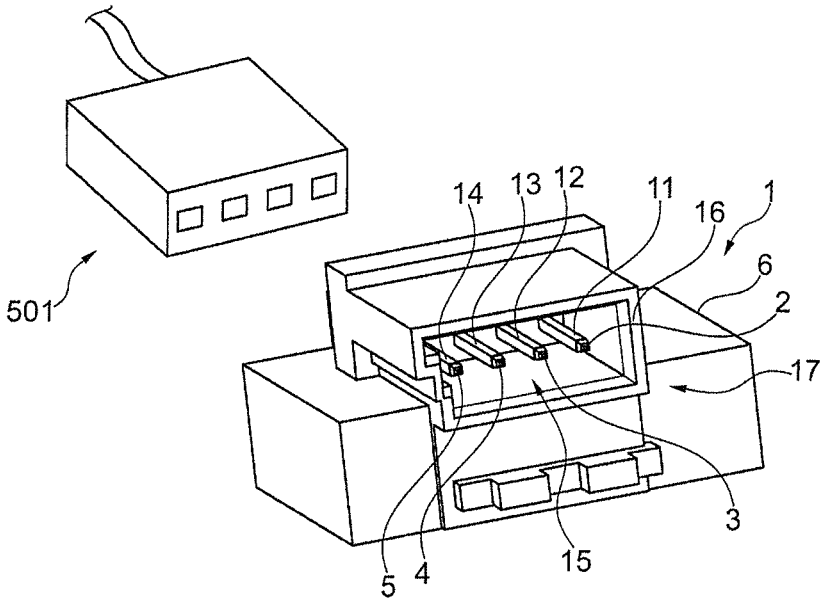
FIG. 1 illustrates a perspective view of a first microphone unit in accordance with the present invention.
Figure 2:
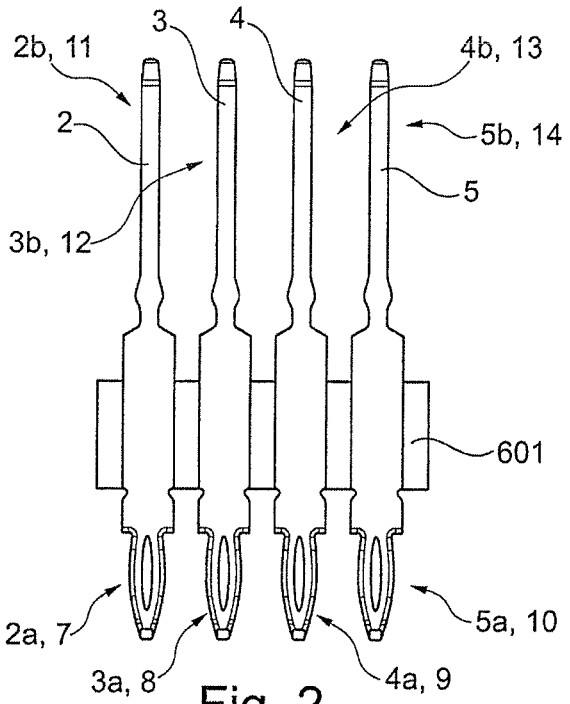
FIG. 2 illustrates a plan view of contacts that are held together by means of a bridge.

FIG. 1 illustrates a perspective view of a first embodiment variant of a microphone unit 1 in accordance with the invention. The microphone unit 1 comprises four contacts 2, 3, 4 and 5, also illustrated in FIG. 2, and a housing 6. The four contacts 2 to 5 pass through the housing 6. First contact ends 2*a* to 5*a* of the contacts 2 to 5 are in each case embodied as pressfit ends 7 to 10 and second contact ends 2*b* to 5*b* are embodied as contact pins 11 to 14. The contact pins 11 to 14 protrude—as illustrated in FIG. 1—into a second hollow chamber 15 of the housing 6 and together with a frame 16 form a socket 17 into which it is possible to plug a plug connector 501 that is illustrated schematically in FIG. 1, so as to incorporate the microphone unit 1 by way of example in a communication system in a vehicle.

Figure 6:
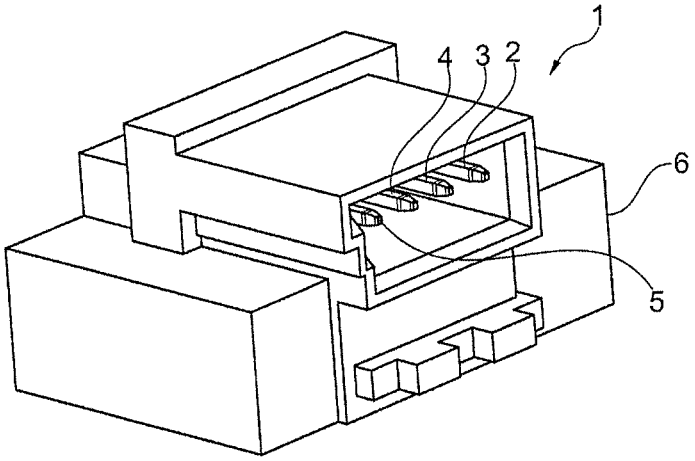
FIG. 6 is a further illustration of the microphone unit illustrated in FIG. 1.
Figure 7:
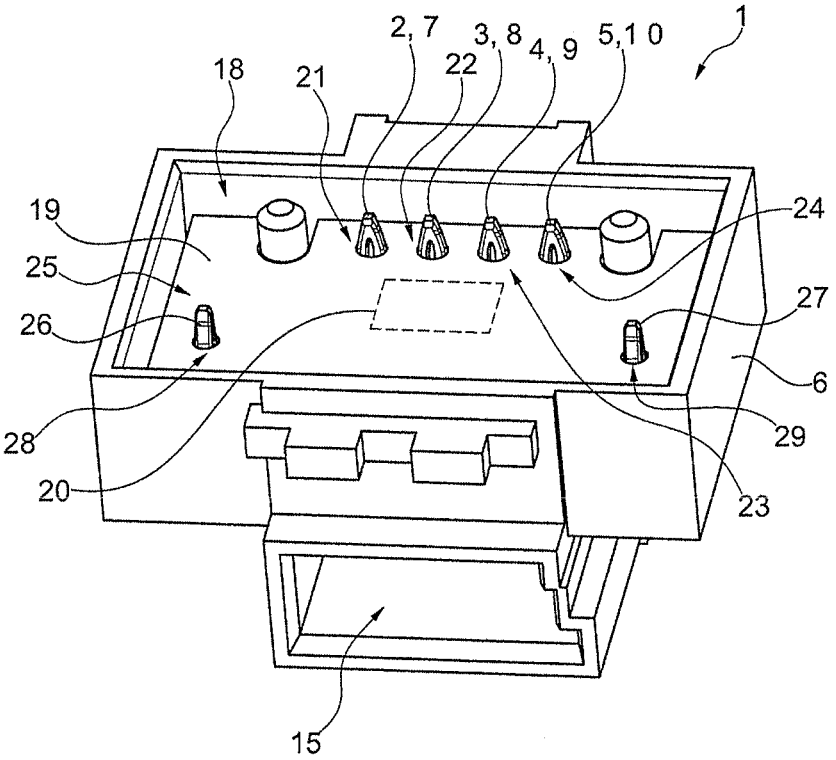
FIG. 7 illustrates a view from below of the microphone unit illustrated in FIGS. 1 and 6.

FIGS. 6 and 7 illustrate other views of the microphone unit 1. Not only is the second hollow chamber 15 visible in FIG. 7, which illustrates an oblique view from below of the microphone unit 1, but rather a first hollow chamber 18 is also evident and the first hollow chamber is already sealed in part by means of a circuit board 19 and a microphone component 20 that is embodied as a so-called SMD component and is indicated schematically by the broken lines is soldered onto an upper face of the circuit board, the upper face being remote from the observer. Four metal-lined through-going bore holes 21 to 24 are formed in the circuit board 19 through which the pressfit ends 7 to 10 of the contacts 2 to 5 that protrude into the first hollow chamber 18 are evident. FIG. 7 illustrates the circuit board 19 in its final mounted position in which electrical connections between the contacts 2 to 5 and the circuit board 19 are already completely produced so that the contacts 2 to 5 also retain the circuit board 19 in a mechanical manner in the illustrated position. In order to provide an additional fixing arrangement of the circuit board 19, which together with the microphone component 20 forms a second assembly 25, the housing 6 also comprises two cast fastening pins 26, 27 that pass through further through-going bore holes 28, 29 of the circuit board 19 and as the circuit board 19 is pushed into the first hollow chamber 18 to form a friction-type connection with the circuit board.

Figure 3:
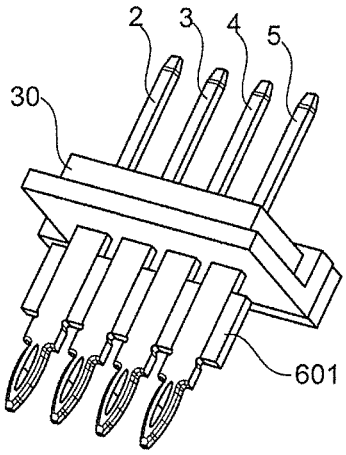
FIG. 3 is a plan view of the contacts illustrated in FIG. 2 together with a retaining plate injection molded thereon.
Figure 4:
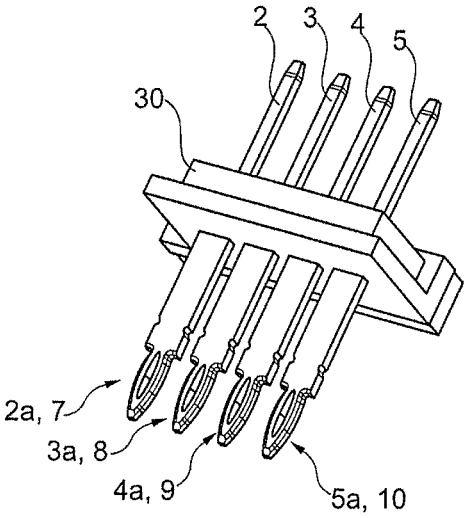
FIG. 4 is an illustration corresponding to FIG. 3, wherein the bridge is removed.
Figure 5:
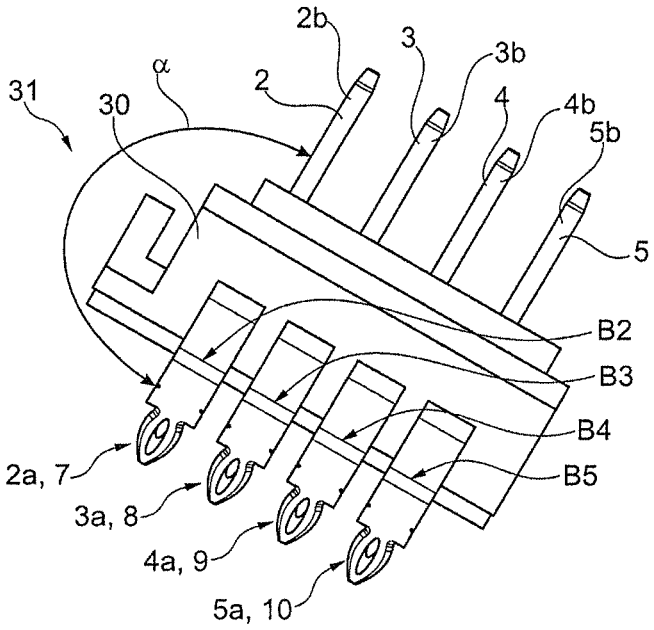
FIG. 5 is an illustration corresponding to FIG. 4 wherein the contacts are bent.

However, prior to the contacts 2 to 5 being insert injection molded with the housing 6 in a so-called "insert molding" method, the contacts are insert injection molded in a first step in a preceding "insert molding" method with a retaining plate 30 in such a manner that the retaining plate 30—as is illustrated in the FIGS. 3 to 5—fixes the contacts 2 to 5 to one another. In order to facilitate the placing of the four contacts 2 to 5 in a hollow chamber of an injection molding mold for the first "insert molding" method, the contacts 2 to 5 are initially—as illustrated in the FIGS. 2 and 3—connected to one another by means of a bridge 601. As is evident from the overview of FIGS. 3 and 4, the bridge 601 is removed after the retaining plate 30 is formed. An overview of FIGS. 4 and 5 illustrates that the first contact ends 2*a* to 5*a* of the contacts 2 to 5 are embodied as pressfit ends 7 to 10 and after the bridge 601 is removed so as to prepare for a second "insert molding" method step are bent in such a manner that the individual contacts 2 to 5 include with their first contact ends 2*a* to 5*a* and second contact ends 2*b* to 5*b* in each case a 90° angle $\alpha$. As is illustrated in FIG. 5, the retaining plate 30 is fixed by means of the "insert molding" process to the contacts 2 to 5 between bends B2 to B5 of the contacts 2 to 5 and the second contact ends 2*b* to 5*b* of the contacts 2 to 5, the second contact ends 2*b* to 5*b* being embodied as contact pins 11 to 15. According to a first variant of the method, the contacts 2 to 5 are bent prior to the retaining plate 30 being formed. According to a second variant of the method, the contacts 2 to 5 are bent after the retaining plate 30 has been produced. Preparations are accordingly made for a first assembly 31 that is embodied from the bent contacts 2 to 5 and the retaining plate 30 to be placed in a hollow chamber of a second injection molding mold, not illustrated, and to be insert injection molded therein in such a manner that the housing 6 illustrated in FIGS. 1, 6 and 7 is produced, wherein it is necessary to mount the circuit board 19 on the housing following the insert injection molding process so as to complete the microphone unit 1. The circuit board 19 (cf. FIG. 7) is mounted in that the circuit board is pressed into the first hollow chamber 18 in the direction in which the pressfit ends 7 to 10 extend and in so doing the electrical contacts are provided between the pressfit ends 7 to 10 and conductor tracks, not illustrated, that are provided on the circuit board 19 are produced. The housing 6 is embodied in such a manner that the first hollow chamber 18 and the second hollow chamber 15 are separated from one another in an air-tight and fluid-tight manner.

Figure 8:
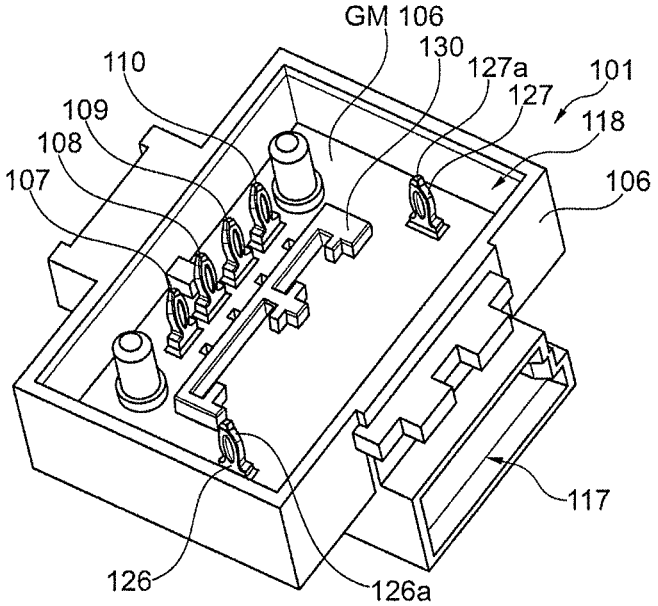
FIG. 8 illustrates a second embodiment variant of the microphone unit in the view from below and with the circuit board removed.
Figure 9:
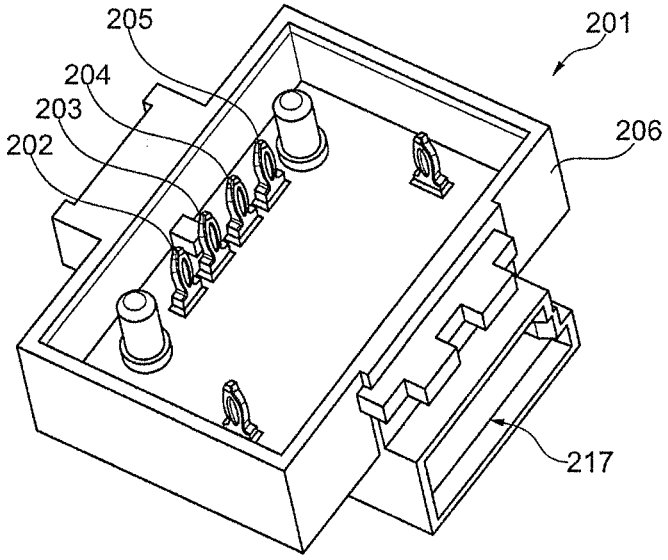
FIG. 9 illustrates a third exemplary variant of the microphone unit in the view from below and with the circuit board removed.

FIG. 8 illustrates a second embodiment variant of a microphone unit 101 in a similar manner to the illustration in FIG. 7, wherein a circuit board has not yet been mounted on a housing 106. Nonetheless, a retaining plate 130 that is cast in the housing 106 is evident in the perspective view and the retaining plate protrudes in part into a first hollow chamber 118. Furthermore, pressfit ends 107 to 110 are evident and the pressfit ends protrude out of a casting compound GM106 of the housing 106 into the first hollow chamber 118. Fastening pins 126, 127 are embodied with pressfit ends 126*a*, 127*a* so that so as to provide the additional fixing of the circuit board, not illustrated, further pressfit connections are produced, wherein these further pressfit connections do not have an electrical function and are used only to retain the circuit board in a mechanical A third embodiment variant of a microphone unit 201 is illustrated in FIG. 9 in a similar manner to the illustration in FIG. 7 or FIG. 8, wherein a circuit board is not mounted on a housing 206. In the case of this embodiment variant, the contacts 202 to 205 are insert injection molded with the housing 206 without the contacts having to be first insert injection molded with a retaining plate. Accordingly, the contacts 202 to 205 were still connected by a bridge during production of the housing 206 so as to be able to handle them as one despite the lack of a retaining plate. In other aspects, the third embodiment variant of the microphone unit 201 is comparable to the second embodiment variant of the microphone unit 101.

As far as the sockets 117 or 217 are concerned, the second and third microphone unit 101 or 201 are embodied in a corresponding manner to the first microphone unit 1. The views 7 to 9 illustrate the microphone units 1 or 101 or 201 in such a manner that second contact ends of the contacts are not visible in each case.

Figure 10:
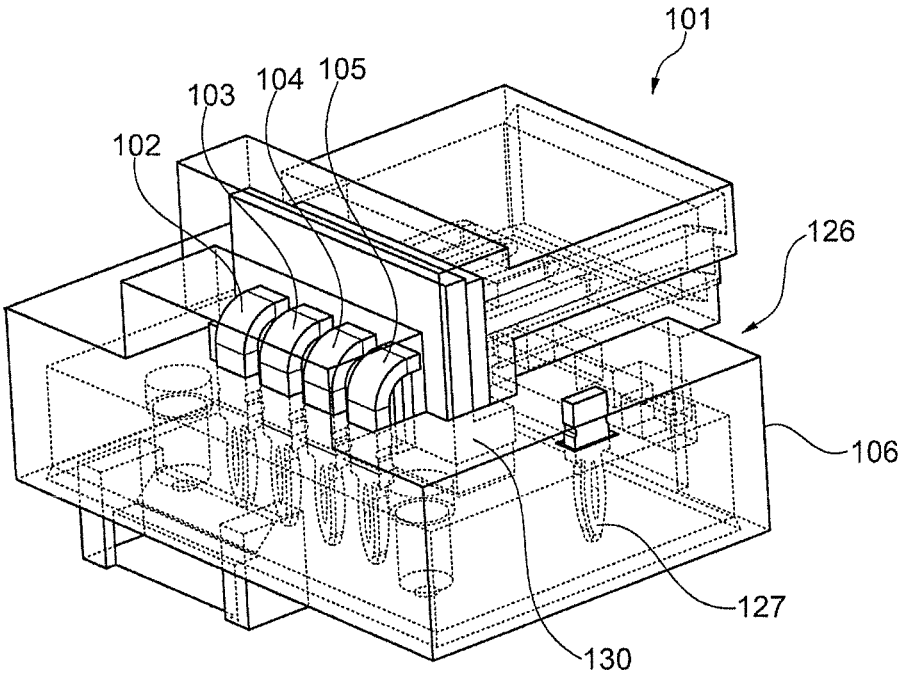
FIG. 10 illustrates a transparent, perspective view of the embodiment variant illustrated in FIG. 8.

Finally, FIG. 10 illustrates the second embodiment variant of the microphone unit 101 as a perspective transparent model with visible and concealed edges. It is evident in this view how the contacts 102 to 105 pass through the housing 106 and how the retaining plate 130 is embedded in the housing 106. A circuit board with a microphone component arranged on the circuit board is not illustrated in FIG. 10, the circuit board is however embodied according to the illustration in FIG. 7, wherein the circuit board naturally comprises suitable through-going bore holes for the fastening pins 126, 127.

LIST OF REFERENCE NUMERALS

1 Microphone unit 1
2-5 Contact
2*a*-5*a* Contact end
2*b*-5*b* Contact end
6 Housing
7-10 Pressfit end
11-4 Contact pin
15 Second hollow chamber of 6
16 Frame of 17
17 Socket
18 First hollow chamber
19 Circuit board
20 Microphone component
21-24 Metal-lined through-going bore hole
25 Second assembly
26, 27 Fastening pin
28, 29 Through-going bore hole
30 Retaining plate
31 First assembly
B2-B5 Bend from 2 to 5
α Angle between 2*a*-5*a* and 2*b*-5*b*
101 Microphone unit
102-105 Contact
107-110 Pressfit end
106 Housing
107-110 Pressfit end
117 Socket
118 First hollow chamber
126, 127 Fastening pin
126*a*, 127*a* Pressfit end
130 Retaining plate
GM106 Casting compound
201 Microphone unit
202-205 Contact
206 Housing
217 Socket
501 Plug connector
601 Bridge

The invention claimed is:

1. A method for producing a microphone unit that can be contacted by a plug connector, comprising:

bending contacts, which are held in an adjacent manner with respect to one another by means of a bridge, in such a manner that first contact ends that are part of the contacts and are adjacent to one another and embodied as pressfit ends include an angle of at least 90° in each case with respect to second contact ends that are part of the contacts and are adjacent to one another, with said second contact ends embodied as contact pins, insert injection molding a first assembly that comprises the contacts with a housing, in such a manner that the pressfit ends of the contacts protrude into a first hollow chamber of the housing and that the contact pins of the contacts protrude into a second hollow chamber of the housing, providing a second assembly, wherein said second assembly is formed by virtue of mounting a microphone component on a circuit board as a surface-mounted device, producing a pressfit connection between the pressfit ends of the contact pins and the circuit board that is populated with the microphone component as the circuit board is inserted into the first hollow chamber in such a manner that in so doing the pressfit ends of the contacts pins are pressed into metal-lined through-going bore holes of the circuit board.

2. The method according to claim 1, wherein prior to insert injection molding the first assembly, the contacts held in the adjacent manner with respect to one another by the means of the bridge are insert injection molded so as to form a retaining plate that fixes the contacts to one another.

3. The method according to claim 2, wherein the contacts are insert injection molded in such a manner that the retaining plate is embodied at the contacts between bends of the contacts and said second contact ends of the contacts, said second contact ends being embodied as the contact pins.

4. The method according to claim 2, wherein the bridge is removed after forming the retaining plate and prior to producing the housing.

5. The method according to claim 1, wherein the bridge is removed after producing the housing.

6. The method according to claim 1, wherein the circuit board is provided with a dust protector after said circuit board is assembled in the first hollow chamber of the housing.

7. The method according to claim 1, wherein during the production of the housing at least one fastening pin that is embodied according to a type of a pressfit end is embedded in the housing in such a manner that said fastening pin protrudes in a parallel manner with respect to the pressfit ends of the contacts in the first hollow chamber.

8. The method according to claim 7, wherein a pressfit connection is also produced between the pressfit end of the connecting pins or the pressfit ends of the connecting pins as the pressfit connection is produced between the pressfit ends of the contact pins and the circuit board.

* * * * *